United States Patent [19]

Thoma

[11] Patent Number: 4,463,617

[45] Date of Patent: Aug. 7, 1984

[54] MILTI-RANGE CYCLE CONTROL TIMER UNIT

[75] Inventor: Fritz Thoma, Haslach, Fed. Rep. of Germany

[73] Assignee: Dieter Graesslin Feinwerktechnik, Fed. Rep. of Germany

[21] Appl. No.: 318,447

[22] Filed: Nov. 5, 1981

[30] Foreign Application Priority Data

Nov. 5, 1980 [DE] Fed. Rep. of Germany ..... 3041687

[51] Int. Cl.[3] ..... H01H 7/08; H01H 43/10

[52] U.S. Cl. ..... 74/3.5; 74/325; 74/330; 74/438; 74/568 T; 200/38 R

[58] Field of Search ..... 74/3.5, 325, 330, 332, 74/438, 567, 568 T, 665 K; 200/38 R, 38 B, 38 BA, 38 D, 38 DA, 38 DL; 337/303

[56] References Cited

U.S. PATENT DOCUMENTS 1,113,704 10/1914 Relle ..... 74/330

FOREIGN PATENT DOCUMENTS 104075 11/1897 Fed. Rep. of Germany ..... 74/332
2810485 9/1978 Fed. Rep. of Germany .
3002570 7/1981 Fed. Rep. of Germany .... 200/38 R

*Primary Examiner*—Allan D. Herrmann
*Attorney, Agent, or Firm*—Hill, Van Santen, Steadman & Simpson

[57] ABSTRACT

A cycle control timer unit in which a rotatable annular program carrier is provided having two opposed sides, each formed with a different range program scale and having a different drive coupler means. The unit includes two different rotary drive transmission wheels facing in one direction and rotated at dissimilar speeds respectively adapted for drive connection with the drive coupler means. By flipping over the sides of the program carrier in the unit and connecting the appropriate drive coupler and drive wheel, an operator may easily switch between the different program ranges for control of the unit.

19 Claims, 11 Drawing Figures

FIG. 1A
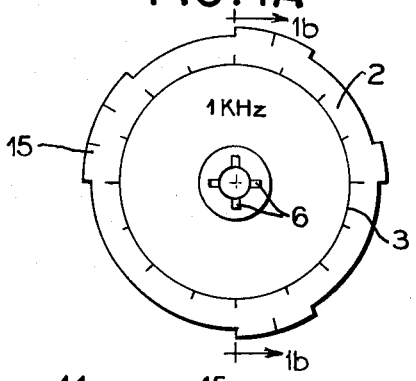
FIG. 1B
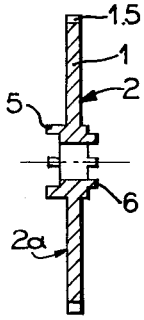
FIG. 1C
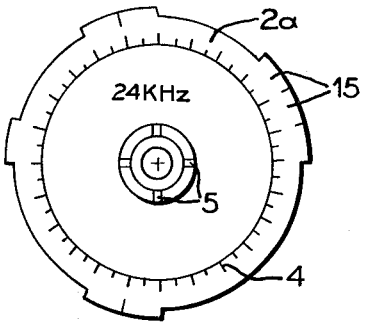
FIG. 2
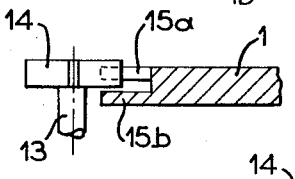
FIG. 3
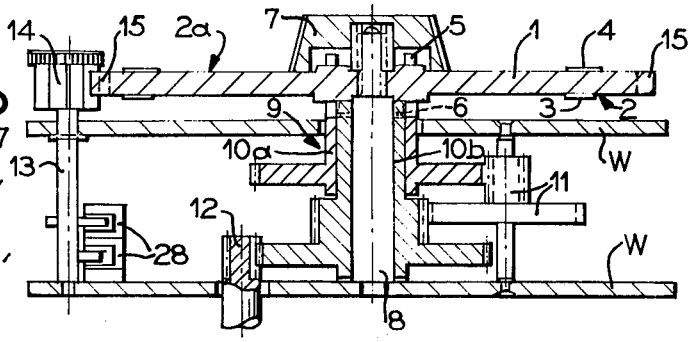
FIG. 8a
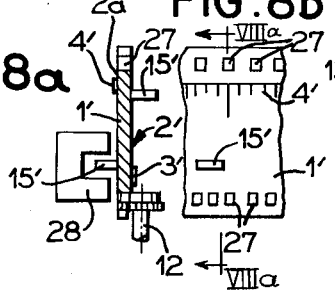
FIG. 8b
FIG. 4
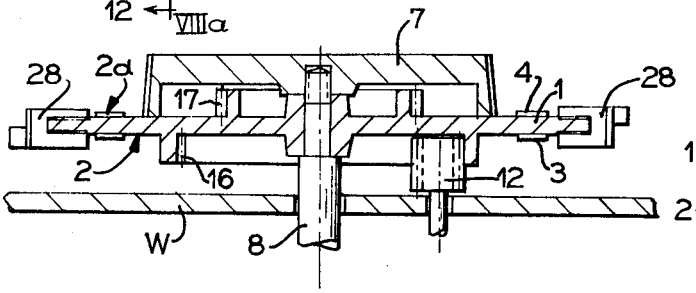
FIG. 7
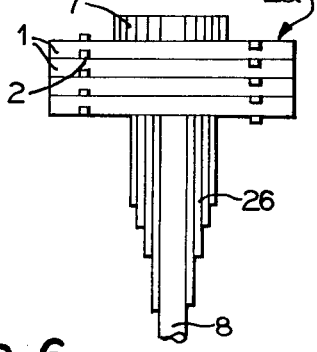
FIG. 5
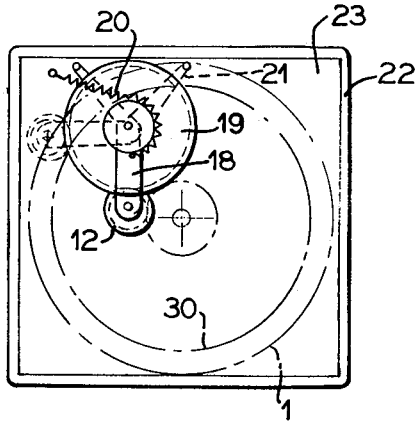
FIG. 6
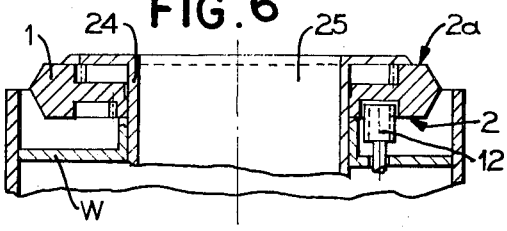

MILTI-RANGE CYCLE CONTROL TIMER UNIT

The invention relates to a multi-range cycle control timer unit comprising a mechanical gearing which is driven by a suitable motor and which affords at least two different rotational speeds for driving of a releasably seated program carrier for controlling mechanical, electrical or electronic switching means, particularly for radio instruments or timing instruments.

Cycle control timer units, particularly in emergency call transmitters for air traffic and maritime navigation, traffic signal systems, industrial robots or timers for controlling heating, air-conditioning and air-circulation, only to mention a few uses, frequently utilize cyclical switching programs operable at mutually differing rotational speeds or cycle times which can only be determined after a system equipped with such a switching program is placed in operation. Therefore, there is a need for multi-range cycle control timer units that can be simply reset to the required switching range, being reset with certainty and free of mistakes without auxiliary means even by an unskilled person.

For known electrical time lag relays for an electrical switch clock with a weekly and daily program range, one same program carrier is permanently connected to the switch clock unit and is allocated to one same contact system. There is typically provided with one changeover gear by means of which program rotational speed can be changed, for example, from one revolution per week to one revolution per day and vice versa. For the scale-wise identification of the program carrier for the respective rotational speed, double scales or two interchangeable single scales may be provided.

These known cycle control timer units are burdened with the considerable disadvantage that the two adjacent scales on the program carrier for the identification of the two ranges as well as embodiments with single scales which can be mutually interchanged lead to mix-ups of the respectively preselected rotational speed relative to the appertaining scale.

In another known cycle control timer unit, an electrical switch clock with a daily and weekly program range, special drive shafts are provided which make it possible to put special single program carriers in place on the switch clock.

With this type of a cycle control timer unit, it must be taken into consideration that two single program carriers, one for the daily program and one for the weekly program, must always be kept on hand, which is not only uneconomical but also can lead to the loss of the program range which is not being used at the moment.

An object of the invention is to eliminate the described disadvantages of the known cycle control timer units and to create a single program carrier for at least two switching program ranges, for which a mix-up of the ranges with one another or a loss of one of the program carrier ranges is impossible.

SUMMARY OF THE INVENTION

A special program range with its own scale is allocated to each opposed side or surface of a program carrier and a separate clutch axle for engagement with a corresponding clutch axle of a rotary program drive is provided for each program range on the program carrier.

Thus, in order to change a program range, a program carrier need only be turned over, engaged with the drive and be axially secured.

What is advantageous given the inventive control timer unit is not only the absolute impossibility of mixing up individual program ranges related to a scale relative to the appertaining drive but, in particular, the single-piece nature of such a multi-range cycle control timer unit. What is further advantageous is the simple serviceability and economical manufacture of such a program carrier according to the invention which can be designed disk-shaped or plate-shaped or drum-shaped or tape-shaped, for triggering a control signal with stationary or positionally movable trip cams or other switch means which trigger control signals are freely programmable and are captively or removably disposed on the program carrier.

BRIEF DESCRIPTION OF THE DRAWING

FIG. 1A is a front side elevational view of a disk-shaped program carrier of the present invention;

FIG. 1B is a cross-sectional view of FIG. 1A taken along lines 16—16;

FIG. 1C is a rear side elevational view of the disc-shaped program carrier of FIG. 1A;

FIG. 2 is a partially cut view through a program carrier with two tracks of trip cams lying above one another;

FIG. 3 is a cross-sectional view through a multi-range cycle control timer unit according to the invention with a claw clutch between the program carrier and a program drive unit;

FIG. 4 is a cross-sectional view through a multi-range cycle control timer unit according to the invention with a toothed wheel coupling between the program carrier and the drive unit;

FIG. 5 is a view of the front side of a drive unit with a toothed wheel clutch half which can be varied radially;

FIG. 6 is a cross-sectional view through a ring-shaped, multi-range cycle control timer unit with a toothed gear coupling between the program carrier and the drive unit;

FIG. 7 is a sectional view of a program carrier arrangement on a drive with a plurality of multi-range program carriers stacked on top of one another;

FIG. **8*a* is a cross-sectional view of FIG. 8*b* taken along lines 8*b*—8*b* and FIG. 8*b*** is a partial side elevational view of a band shaped multi-range program carrier of the present invention.

DESCRIPTION OF THE PREFERRED EMBODIMENTS

A disk-shaped program carrier 1, being particularly one-piece and made of synthetic plastic material, is provided with opposed scale 3 and 4 on the two respective opposed plane surfaces 2 and **2*a*. Each of the sides 2 or 2*a* corresponds to a program range. Respective clutch axle halves 5 and 6 are provided on the disk carried for engagement with corresponding drive shafts provided for respective rotation for each of the two program ranges. The clutch halves 5 and 6 are particularly designed as so-called claw clutches, whereby the spacings of the claws of the one half 5 differ relative to the claws of the half 6, as FIGS. 1A, 1B, and 1C** clearly show.

As FIG. 3 shows in greater detail, the clutch half 6 belongs to the side 2 with the scale 3 and the clutch half 5 belongs to the side 2a with the scale 4 of the program carrier 1 which is coaxially positioned on a rotatable shaft or bearing pin 8 by means of a removable stop nut 7. The clutch half 6 of the program carrier 1 is in drive connection with a congruent clutch axle half 9 of one of two drive wheels 10a and 10b which are seated in suitable housing walls W concentrically and coaxially relative to the bearing pin 8 but rotate with rotational speeds which differ from one another. The two said drive wheels 10a and 10b are interconnected for rotation with one another via a gear wheel assembly 11, and the drive wheel 10a is directly driven by a pinion 12 of a main driveshaft from any suitable rotary motor means.

For the purpose of changing the program range, the program carrier 1 is first removed from the bearing pin 8, then turned over or flipped in position 180° and again put in place on the bearing pin 8. The corresponding clutch half is brought into engagement with the respective drive wheel clutch and locked in place on the pin 8 by means of the nut 7.

A control shaft 13 with a star wheel 14 is periodically engaged and turned in conformity with the switching program by trip cams 15 formed along the outer annular edge of the program carrier 1 for triggering control signals to corresponding time activated system devices.

As FIG. 2 shows, it can be provided that the program carrier 1 is provided with a respective separate track of trip cams 15a and 15b per program range, if need be, which can be individually programmed independently of one another for each program range. The tracks of trip cams 15a and 15b can be spatially disposed above one another and be connected integrally to the program carrier. The tracks of trip cams 15a and 15b can be divided into individual cam sectors over the circumference, said individual cams being broken out to form a switching program. It has also been conceived to provide so-called trip riders 28 on the program carrier 1 instead of trip cams, the trip riders 28 being shown in greater detail in FIG. 4. Such freely programmable trip riders 28 can be designed so as to be removable or non-removable from the program carrier 1.

As shown in FIG. 4, the gear coupling between the drive and the program carrier 1 may be in the form of a planet gear coupling. To this end, the program carrier 1 is provided with an exterior facing gear rim 17 along side 2a and the side 2a is provided with an interior facing other gear rim 16. The inside gear rim 16 is engaged with the pinion 12 of the main drive. If the program range is now to be interchanged, then, by means of releasing the axially-limiting stop nut 7, the program carrier 1 is removed from the bearing pin 8 and is turned over, i.e., flipped, and is again put in place on the bearing pin, whereby the outside gear rim 17 now engages with the pinion 12. The rotary direction is not changed due to the change of range. A specific transmission ratio which corresponds to the difference of rotary speed or time of rotation between the two program ranges and which can be changed within specific limits exists between the inside gear rim 16 and the pinion 12 or, respectively, between the outside gear rim 17 and the pinion 12. Given the present type of coupling, two spatially offset pinions 12 of a central drive can, if need be, be provided between the program carrier 1 and the drive for greater transmission differences between the individual program ranges.

For multi-range cycle control timer units in which—within suitable limits—any desired transmission which proceeds linearly or according to a specific mathematical function is intended to extend between a central drive via an existing program carrier for activation of the final control, it can be provided, as shown in FIG. 5, that the pinion 12 is seated on a pivotable bracket 18 for movement around a drive wheel 19 and under the influence of a return spring power 20 and can be positioned into engagement, in conformity with the drive, with a respective outside gear rim 30 of a program carrier 1 via a pivotally movable setting lever 21. In FIG. 5, 22 indicates a housing frame of a multi-range cycle control timer unit and 23 indicates a front plate of the unit.

FIG. 6 shows a multi-range cycle control timer unit employing an annular ring-shaped multi-range program carrier 1, with respective outside and inside toothed gear rims coupling between the individual program carrier side 2, or, respectively, 2a, and the drive pinion 12 of the main rotary drive. Suitable, respective scales can be disposed as program ranges on the sides 2 and, respectively, 2a. Trip cams or other trip riders can be disposed along the annular edge faces of the ring. For purposes of changing the program range, the annular program carrier 1 is simply released from a removable bearing flange 24, is flipped or turned in position by 180° and is again put in place on the bearing flange and is axially fixed by means of a positional lock which is not shown in greater detail. A hollow space 25 of the bearing flange provides a vacant area for mounting aditional unit elements in compact spatial relation with the carrier 1, whereby the program carrier 1 turns around these so mounted elements.

FIG. 7 shows an arrangement of a plurality of inventive multi-range program carrier disks 1 stacked above one another which, as already described in FIG. 1, are provided with corresponding scales as well as with clutch axles halves on their respective opposed sides 2 and 2a. The carrier clutch halves serve to respectively engage with corresponding drive clutch axle halves disposed at free ends of drive wheels or tubes 26 which are seated concentrically for relative rotation with respect to one another as the result of different suitable gear coupling connections. The drive tubes 26 have rotational speeds which differ from one another.

The inventive arrangement described above for creating a multi-range cycle control timer unit can also be transferred to band-shaped program carriers 1. In FIG. 8a and 8b, for example, a band-shaped program carrier 1' is provided with sprocket holes 27 in the area of its outer edges for drive engagement with the first pinion 12 of a suitable rotary drive unit. Of course, spur gearing can replace the sprocket holes 27. Scales 3' and 4' are provided on opposed carrier sides 2' and, respectively, 2a'. Moreover, respective trip cams 15' or other signal-triggering elements or markings are provided along the planar surface of each side 2' and 2a'. For the purpose of changing the program range, the program carrier 1' is lifted out of the drive flipped or turned by 180° and is brought into engagement with a second drive pinion (not shown) which exhibits a different rotational speed than the pinion 12.

A further expedient execution of a program carrier can lie in a cubical form in which all six sides of the cube can be provided with their own scale, corresponding control means in the form of trip cams or trip riders or other control means, and corresponding clutch halves for the selectable engagement with corresponding clutch halves of a main drive.

Although various minor modifications may be suggested by those versed in the art, it should be understood that I wish to embody within the scope of the patent warranted hereon all such modifications as reasonably and properly come within the scope of my contribution to the art.

I claim:

1. A control timer unit for use with multiple range cycles comprising a gear means driven by a motor and having at least one rotary output means facing in one direction and a rotatable continuous program carrier releasably mounted in said unit for cylically triggering signal switch means, said program carrier being formed with at least two opposed sides, each having a respective, different program range scale and a respective different clutch portion for selectively engaging with said at least one rotary output means for driving said carrier at different rotational speeds each associated for use with one particular program range scale depending on which side is facing said rotary output means.

2. The control timer unit of claim 1, wherein said program carrier is disk-shaped with two opposed planar sides.

3. The control timer unit of claim 1, wherein said program carrier is ring-shaped with two oppositely angled annular sides formed along the circumferential edge of said carrier.

4. The control timer unit of claim 1, wherein said program carrier is band-shaped with opposed inner and outer longitudinal facing sides.

5. The control timer unit of claim 1, wherein each side of said program carrier is formed with trip cam means for triggering said signal switch means.

6. The control timer unit of claim 5, wherein said trip cam means are spaced differently along said sides.

7. The control timer unit of claim 1, wherein each side of said program carrier is formed with relatively movable trip rider means for triggering said signal switch means.

8. The control timer unit of claim 7, wherein said trip rider means are spaced differently along said sides.

9. The control timer unit of claim 1, wherein there are at least two rotary output means in the form of concentrically arranged claw clutch wheels.

10. The control timer unit of claim 1, wherein there are at least two rotary output means in the form of concentric, differently elongated tubes.

11. The control timer unit of claim 10, wherein there are at least two program carriers stacked coaxially with one another and simultaneously respectively driven by said tubes.

12. The control timer unit of claim 1, wherein said clutch portions are gear rims and the at least one rotary output means is a pinion engageable with said gear rims.

13. The control timer unit of claim 12, wherein said pinion is seated on a selectively pivotable bracket having a spring bias means for bringing said pinion into engagement with one of said gear rims.

14. The control timer unit of claim 1, wherein said program carrier is in the form of one integral piece.

15. A program carrier adapted for connection to a rotary drive output to cyclically trigger signal switch means in a control timer unit comprising an annular member adapted to be releasably mounted for rotation in said unit, said member having at least two opposed sides each having a respective, different program range scale and a respective different clutch portion for selectively engaging with said rotary drive output for driving said carrier at different rotational speeds each associated for use with one particular program range scale depending on which side is facing said rotary drive output.

16. The program carrier of claim 15, wherein said carrier is annular and has two oppositely facing planar sides.

17. The program carrier of claim 16, wherein said clutch portions are gear rims of differing diameters.

18. The program carrier of claim 15, wherein each side of said program carrier is formed with trip cam means for triggering said signal switch means.

19. The program carrier of claim 18, wherein said trip cam means are spaced differently along said sides.

* * * * *